US009229427B2

(12) United States Patent
Sue

(10) Patent No.: US 9,229,427 B2
(45) Date of Patent: Jan. 5, 2016

(54) OPTICAL SCANNING DEVICE AND IMAGE FORMING APPARATUS

(71) Applicant: KYOCERA Document Solutions Inc., Osaka (JP)

(72) Inventor: Tomohiro Sue, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/682,992

(22) Filed: Apr. 9, 2015

(65) Prior Publication Data

US 2015/0293493 A1 Oct. 15, 2015

(30) Foreign Application Priority Data

Apr. 10, 2014 (JP) ..... 2014-081066

(51) Int. Cl.
*G03G 21/20* (2006.01)
*G03G 15/04* (2006.01)

(52) U.S. Cl.
CPC ..... *G03G 21/20* (2013.01); *G03G 15/0409* (2013.01)

(58) Field of Classification Search
CPC ..... H04N 1/04; G03G 15/04; G03G 15/0409; G03G 21/20; G02B 26/12; B41J 2/455; B41J 2/45; B41J 2/451; B41J 2/471
See application file for complete search history.

(56) References Cited

U.S. PATENT DOCUMENTS

| | | | | |
|---|---|---|---|---|
| 8,654,173 | B2 | 2/2014 | Nakano et al. | |
| 8,743,170 | B2 | 6/2014 | Nakano et al. | |
| 2011/0129259 | A1 | 6/2011 | Nakano et al. | |
| 2013/0164037 | A1 | 6/2013 | Nakano et al. | |
| 2014/0354757 | A1 * | 12/2014 | Narita | B41J 2/471 347/261 |

FOREIGN PATENT DOCUMENTS

| | | | | |
|---|---|---|---|---|
| CN | 101833263 A | * | 9/2010 | B41J 2/471 |
| JP | 2011-137941 A | | 7/2011 | |

* cited by examiner

*Primary Examiner* — Sarah Al Hashimi
(74) *Attorney, Agent, or Firm* — Studebaker & Brackett PC

(57) ABSTRACT

An optical scanning device includes a housing, a polygon mirror, and a motor. The polygon mirror is disposed in the housing and reflects light incident thereon while being rotated. The motor is disposed in the housing and rotates the polygon mirror. The housing has a cooling passage that cools the interior of the housing. The cooling passage is asymmetrically located relative to a rotation shaft of the motor in a cross section perpendicular to the main scanning direction.

8 Claims, 5 Drawing Sheets

OPTICAL SCANNING DEVICE AND IMAGE FORMING APPARATUS

INCORPORATION BY REFERENCE

The present application claims priority under 35 U.S.C. §119 to Japanese Patent Application No. 2014-081066, filed Apr. 10, 2014. The contents of this application are incorporated herein by reference in their entirety.

BACKGROUND

The present disclosure relates to optical scanning devices and image forming apparatuses.

A typical image forming apparatus includes four photosensitive drums for four different colors to form a color image on a sheet. For simplifying the optical design and reducing the cost, such an image forming apparatus includes two laser scanning units (LSUs) for four photosensitive drums. That is, one LSU is shared between two photosensitive drums. Each LSU includes one polygon mirror and one motor. Each LSU rotates the polygon mirror by the motor and scans the two photosensitive drums with a laser beam, forming an electrostatic latent image on the respective photosensitive drums.

While being driven, the motors generate heat to raise the internal temperature of the housing of the LSUs, which may cause thermal deformation of the optical components or peripheral components. As a consequence, toner images of four colors, which are formed based on the four electrostatic latent images on the four photosensitive drums, may deviate from one another when the toner images are overlaid on a sheet. That is, misregistration of colors may occur.

In particular, when one polygon mirror is used to scan two photosensitive drums with light, the scanning direction on one of the photosensitive drums is opposite to the scanning direction on the other. Thus, images of the colors corresponding to the respective photosensitive drums deviate in opposite directions. Such deviation is more noticeable as compared with the case where color images are deviated in the same direction.

In view of the above, each LSU is provided with cooling passages, one below and another above the motor, for restricting the rise in the internal temperature of the housing. This is effective to restrict deviation of images of the respective colors. The cooling passage is located symmetrically relative to the rotation shaft of the motor.

SUMMARY

According to a first aspect of the present disclosure, an optical scanning device forms an image on a scanning target by scanning the scanning target with light in a main scanning direction. The optical scanning device includes a housing, a polygon mirror, and a motor. The polygon mirror reflects light incident thereon while being rotated. The motor is disposed in the housing and rotates the polygon mirror. The housing has a cooling passage that cools an interior of the housing. The cooling passage is asymmetrically located relative to a rotation shaft of the motor in a cross section perpendicular to the main scanning direction.

According to a second aspect of the present disclosure, an image forming apparatus includes the optical scanning device according to the first aspect described above and an image forming section. The image forming section forms an image on a sheet based on the image formed on the scanning target by the optical scanning device.

DETAILED DESCRIPTION

Figure 1:
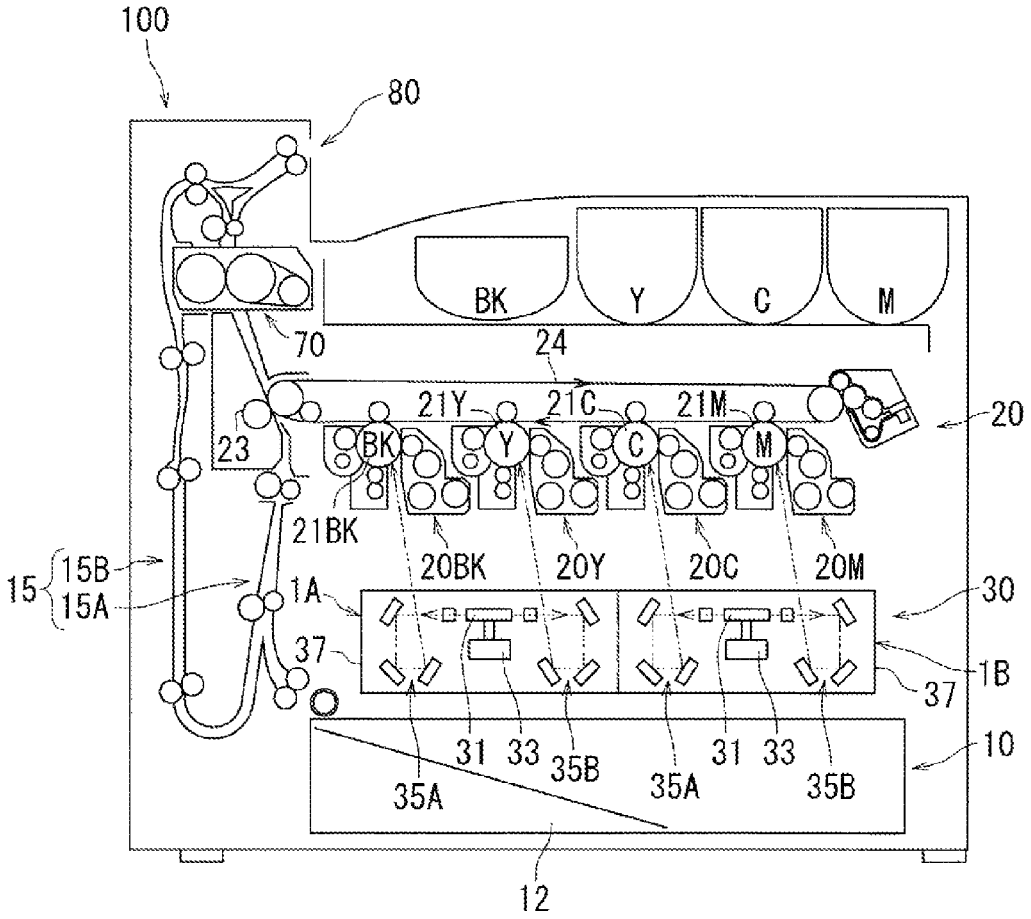
FIG. 1 is a cross-sectional view showing the internal structure of an image forming apparatus according to an embodiment of the present disclosure.

The following describes an embodiment of the present disclosure, with reference to the accompanying drawings. In the figures, the same reference signs are used to denote identical or corresponding elements, and no overlapping explanation is repeated. FIG. 1 is a cross-sectional view showing the internal structure of an image forming apparatus 100 according to the embodiment of the present disclosure. In present embodiment, the image forming apparatus 100 is a printer. The image forming apparatus 100 includes a feeding section 10, a conveying section 15, an image forming section 20, an image writing section 30, a fixing section 70, and a discharging section 80. The conveying section 15 includes a conveyance path 15A and a reverse conveyance path 15B.

The feeding section 10 includes a cassette 12 for storing sheets and feeds a sheet stored in the cassette 12 into the conveyance path 15A. The conveying section 15 conveys the sheet to the image forming section 20 through the conveyance path 15A.

The image forming section 20 includes photosensitive drums 21BK, 21Y, 21C, and 21M (each of which is a scanning target) and units 20BK, 20Y, 20C, and 20M. Each of the units 20BK to 20M includes a charger, a developing device, a static eliminator, and a cleaner. The charger in each of the units 20BK to 20M charges the corresponding one of the photosensitive drums 21BK to 21M.

The image writing section 30 includes a laser scanning unit 1A (an optical scanning device) and a laser scanning unit 1B (an optical scanning device) according to the embodiment of the present disclosure. Hereinafter, the laser scanning units 1A and 1B are respectively referred to simply as LSU 1A and LSU 1B. The LSU 1A is provided for scanning the photosensitive drums 21BK and 21Y, whereas the LSU 1B is for scanning the photosensitive drums 21C and 21M.

The LSU 1A forms an electrostatic latent image (an image) on the photosensitive drum 21BK by directing a laser beam (light) to scan the photosensitive drum 21BK that is in the charged state. The LSU 1A forms an electrostatic latent image (an image) on the photosensitive drum 21Y by directing a laser beam (light) to scan the photosensitive drum 21Y that is in the charged state.

The LSU 1B forms an electrostatic latent image (an image) on the photosensitive drum 21C by directing a laser beam (light) to scan the photosensitive drum 21C in the charged state. The LSU 1B forms an electrostatic latent image (an image) on the photosensitive drum 21M by directing a laser beam (light) to scan the photosensitive drum 21M in the charged state.

The main scanning direction on each of the photosensitive drums 21BK to 21M is parallel to the rotation shaft of a corresponding one of the photosensitive drums 21BK and 21M.

The developing devices in the units 20BK, 20Y, 20C, and 20M each develops an electrostatic latent image formed on the circumferential surface of the corresponding one of the photosensitive drums 21BK, 21Y, 21C, and 21M into a toner image of a corresponding one of the colors of black, yellow, cyan, and magenta.

The image forming section 20 additionally includes a primary transfer belt 24 and a secondary transfer roller 23. The toner images formed on the photosensitive drums 21BK to 21M are transferred to be overlaid on the primary transfer belt 24 so as to form a color image. The secondary transfer roller 23 sandwiches the sheet with the primary transfer belt 24 and transfers the color image formed on the primary transfer belt 24.

As has been described above, the image forming section 20 forms an image on a sheet based on the electrostatic latent images formed on the photosensitive drums 21BK to 21M by the LSUs 1A and 1B.

The conveying section 15 conveys a sheet having an image formed thereon to the image forming section 70 through the conveyance path 15A. The fixing section 70 applies heat and pressure to fix the image onto the sheet. The conveying section 15 conveys the sheet having the fixed image thereon to the discharging section 80. The discharging section 80 discharges the sheet onto an exit tray.

To form an image on both sides of a sheet, the discharging section 80 conveys the sheet from the downstream end to the upstream end of the conveyance path 15A through the reverse conveyance path 15B after an image is formed on one side of the sheet. The conveying section 15 further conveys the sheet to the image forming section 20 through the conveyance path 15A. The image forming section 20 then forms an image on the other side of the sheet. After the images are formed on both sides of the sheet, the sheet is conveyed through the conveyance path 15A to the fixing section 70 and then to the discharging section 80 where the sheet is discharged to the exit tray.

With reference to FIGS. 1 to 4, the following explains the LSUs 1A and 1B in detail. Note that the LSU 1B is identical in structure to the LSU 1A, and therefore an explanation thereof is omitted. More specifically, the explanation of the LSU 1A is likewise applicable to the LSU 1B by reading the LSU 1A as the LSU 1B, the photosensitive drum 21BK as the photosensitive drum 21C, and the photosensitive drum 21Y as the photosensitive drum 21M.

As shown in FIG. 1, the LSU 1A includes a housing 37, a polygon mirror 31, a motor 33, an output optical system 35A, and an output optical system 35B. The polygon mirror 31 is disposed in the housing 37 and reflects a laser beam (light) while being rotated. The motor 33 is disposed in the housing 37 and rotates the polygon mirror 31.

The light-emitting optical systems 35A and 35B are disposed in the housing 37 to direct a laser beam reflected from the polygon mirror 31 toward the photosensitive drum 21BK and the photosensitive drum 21Y, respectively.

Figure 2:
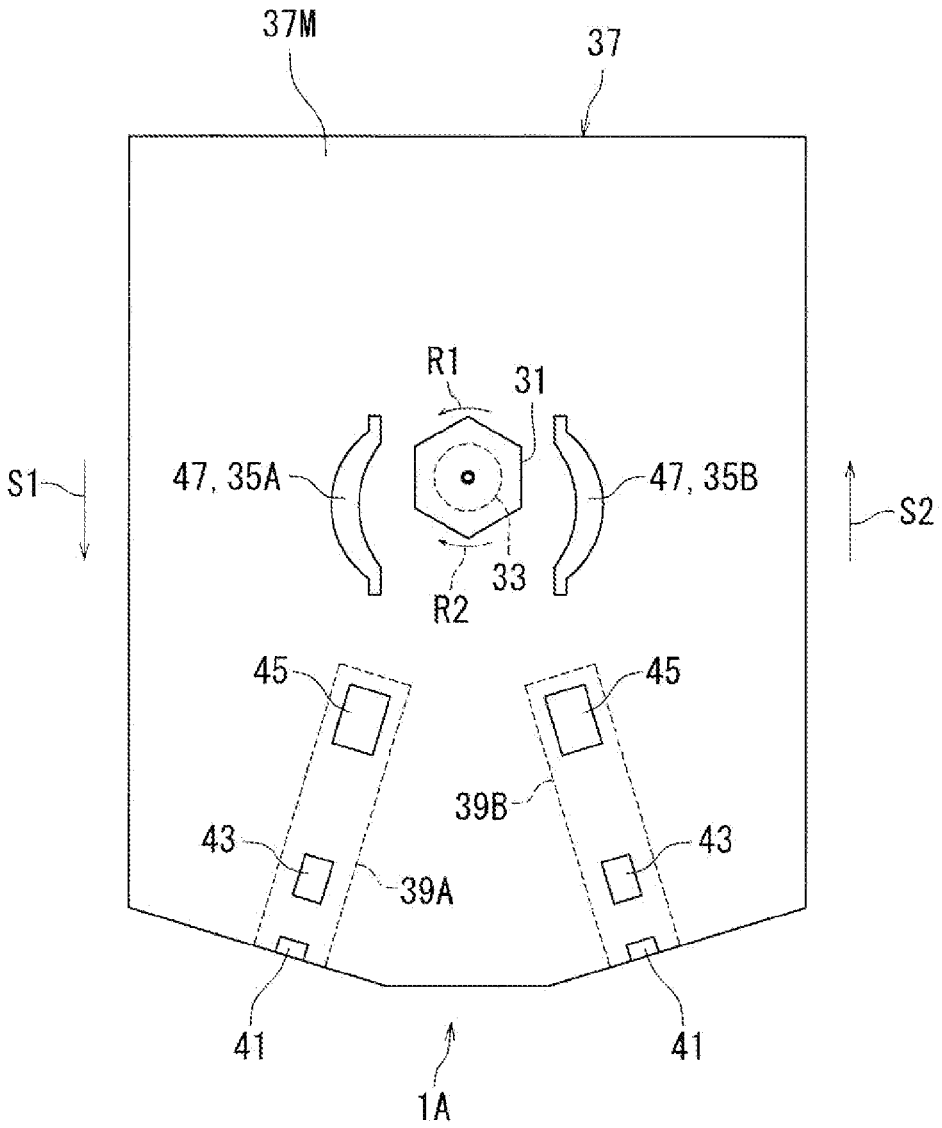
FIG. 2 is a plan view showing the internal structure of a laser scanning unit according to the embodiment of the present disclosure.

FIG. 2 is a plan view showing the internal structure of the LSU 1A. The housing 37 includes a base 37M. The polygon mirror 31 and the motor 33 are located in an approximately central region of the base 37M. The base 37M is provided with two fθ lenses 47 with the polygon mirror 31 located therebetween. One of the two fθ lenses 47 is part of the output optical system 35A, and the other is part of the output optical system 35B.

The LSU 1A additionally includes an input optical system 39A (first optical system) and an input optical system 39B (second optical system). The input optical systems 39A and 39B are disposed on the base plate 37M to be symmetrical to each other relative to a rotation shaft AX of the motor 33. The input optical system 39A is provided for the fθ lens 47 of the output optical system 35A, whereas the input optical system 39B is provided for the fθ lens 47 of the output optical system 35B. The input optical systems 39A and 39B each emit a laser beam to the polygon mirror 31.

More specifically, each of the input optical systems 39A and 39B includes a laser diode 41, a collimating lens 43, and a cylindrical lens 45. The laser diode 41 emits a laser beam. The collimating lens 43 collimates the laser beam emitted by the laser diode 41 into parallel rays of light. The cylindrical lens 45 directs the parallel rays of light from the collimating lens 43 to form a linear image on the polygon mirror 31.

The polygon mirror 31 is rotatable in a rotation direction R1. More specifically, the motor 33 rotates the polygon mirror 31 such that the reflecting surface that is facing the cylindrical lens 45 of the input optical system 39A is moved, over the shortest distance, to a position to face the cylindrical lens 45 of the input optical system 39B.

The polygon mirror 31 directs the laser beam received from the input optical system 39A toward the fθ lens 47 of the output optical system 35A. The fθ lens 47 adjusts the scanning speed of the laser beam directed to the photosensitive drum 21BK to be constant. At the same time, the polygon mirror 31 directs light received from the input optical system 39B toward the fθ lens 47 of the output optical system 35B. The fθ lens 47 adjusts the scanning speed of the laser beam directed to the photosensitive drum 21Y to be constant.

The polygon mirror 31 is fixed to the rotation shaft AX of the motor 33. Therefore, the polygon mirror 31 rotates in the rotation direction R1 as the motor 33 rotates in the rotation direction R1. A first direction S1 is determined to be the main scanning direction of the laser beam emitted from the fθ lens 47 of the output optical system 35A on the photosensitive drum 21BK. On the other hand, a second direction S2 that is opposite to the first direction S1 is determined to be the main scanning direction of the laser beam emitted from the fθ lens 47 of the output optical system 35B on the photosensitive drum 21BK. The first direction S1 and the second direction S2 are generically referred to as the main scanning directions.

The following explains the temperature distribution within the housing 37. The temperature distribution is determined depending on the rotation direction of the motor 33. More specifically, when the motor 33 rotates in the rotation direction R1, the temperature tends to be higher at a region where the input optical system 39B is located than at a region where the input optical system 39A is located. That is, as a result of rotation of the polygon mirror 31, the region where the input optical system 39B is located is exposed to a higher temperature than the region where the input optical system 39A is located.

Figure 3:
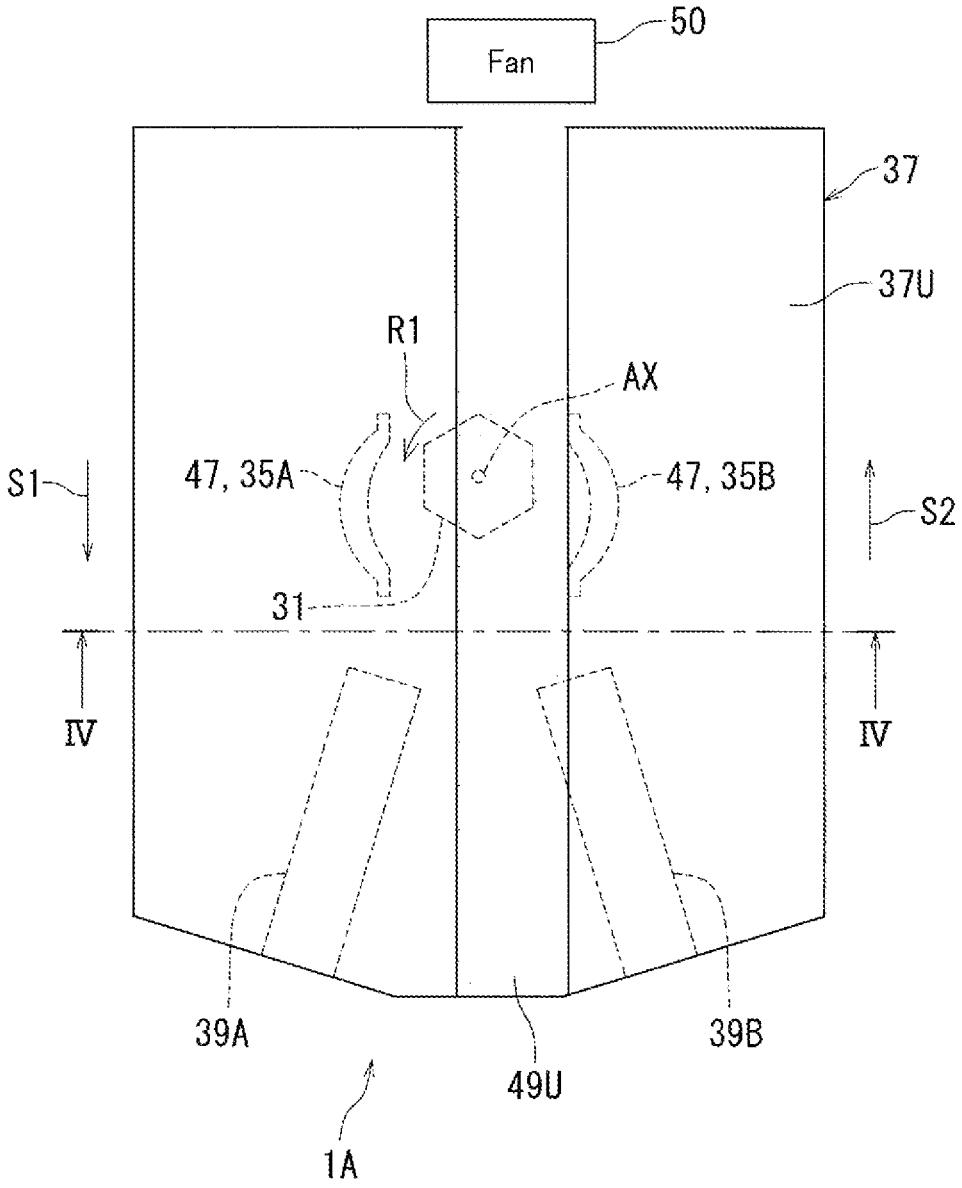
FIG. 3 is a plan view of the laser scanning unit according to the embodiment of the present disclosure.
Figure 4:
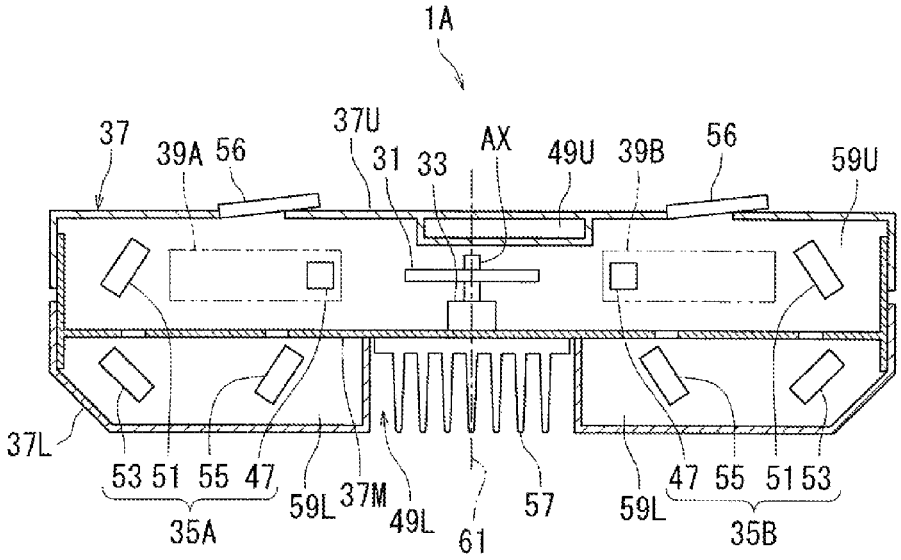
FIG. 4 is a cross-sectional view of the laser scanning unit according to the embodiment of the present disclosure.

To reduce the temperature difference between the regions where the respective optical systems 39A and 39B are disposed, the LSU 1A is provided with a cooling passage 49U (first cooling passage) asymmetrically located relative to the rotation shaft AX of the motor 33 as shown in FIGS. 3 and 4. In other words, the housing 37 has the cooling passage 49U for cooling the interior of the housing 37.

FIG. 3 is a plan view of the LSU 1A. The LSU 1A additionally includes a fan 50 (blower). The housing 37 additionally includes an upper closure 37U (cover). The upper closure 37U has a lower surface forming the cooling passage 49U. The cooling passage 49U extends in the main scanning direction. The fan 50 is located to face one end of the cooling passage 49U to blow gas (air, in the present embodiment) into the cooling passage 49U.

The cooling passage 49U is located closer to the input optical system 39B than to the input optical system 39A. In other words, the cooling passage 49U is located closer to a region where the temperature tends to be higher. Consequently, the cooling passage 49U can reduce difference in the temperature distribution between the respective regions where the input optical systems 39A and 39B are located. In addition, the cooling passage 49U can reduce the rise in the internal temperature of the housing 37.

FIG. 4 is a cross sectional view taken along the line IV-IV of FIG. 3. The upper closure 37U covers the base 37M from above. The housing 37 additionally includes a lower closure 37L. The lower closure 37U covers the base 37M from below. Consequently, the interior space of the housing 37 is partitioned into at least one first space 59U and at least one second space 59L. In other words, the upper closure 37U encloses the first space 59U, whereas the lower closure 37L encloses the second spaces 59L. According to the present embodiment, one first space 59U and two second spaces 59L are formed.

The motor 33 is secured to the upper surface of the base plate 37M and thus located in the first space 59U. The cooling passage 49U is asymmetrically located relative to the rotation shaft AX (axis 61) of the motor 33 in a cross section perpendicular to the main scanning direction.

The housing 37 is provided with a cooling passage 49L (second cooling passage). The cooling passages 49L and 49U are located with the motor 33 in between. The cooling passage 49L restricts the rise in the internal temperature of the housing 37. The cooling passage 49L is defined by the lower surface of the base plate 37M and the lower closure 37L and extends in the main scanning direction. The cooling passage 49L is located symmetrically relative to the rotation shaft AX (axis 61). The fan 50 (see FIG. 3) blows gas (air in the present embodiment) into the cooling passage 49L. The fan 50 is shared between the cooling passages 49U and 49L, which can lead to cost reduction.

The LSU 1A additionally includes a heat sink 57. The heat sink 57 is disposed in the cooling passage 49L and fixed to the lower surface of the base plate 37M at a position opposite the motor 33. This can improve the cooling effect of the motor 33.

Since the motor 33 is located in the first space 59U, the temperature in the first space 59U tends to be higher than in the second space 59L. Note in addition that the input optical systems 39A and 39B (see FIG. 2) are both located in the first space 59U. To effectively reduce difference in the temperature distribution between the respective regions where the input optical systems 39A and 39B are located, the cooling passage 49U, out of the cooling passages 49U and 49L, is located near the input optical system 39B.

The LSU 1A additionally includes two dust preventing members 56 that are transparent or semi-transparent plate-like members. Each dust preventing member 56 extends in the main scanning direction and closes an opening formed in the upper closure 37U. The dust preventing members 56 prevent dust particles from entering into the housing 37 to contaminate the optical components disposed therein, while allowing a laser beam to pass through. Note that the dust preventing members 56 are omitted in FIG. 3.

On the upper surface of the base plate 37M, the fθ lens 47 and the reflecting mirror 51 of the output optical system 35A are located symmetrically to the fθ lens 47 and the reflecting mirror 51 of the output optical system 35B relative to the rotation shaft AX (axis 61). On the lower surface of the base plate 37M, the reflecting mirrors 53 and 55 of the output optical system 35A are located symmetrically to the reflecting mirrors 53 and 55 of the output optical system 35B relative to the rotation shaft AX (axis 61). Note that the reflecting mirrors 51 to 55 are omitted in FIG. 2.

The input optical systems 39A and 39B are located in the first space 59U. A laser beam emitted by the input optical system 39A is reflected by the polygon mirror 31 and reaches the output optical system 35A. In the output optical system 35A, the laser beam travels via the fθ lens 47 and the reflecting mirrors 51 to 55 to exit the output optical system 35A through the dust preventing member 56 to irradiate the photosensitive drum 21BK (see FIG. 1). A laser beam emitted by the input optical system 39B is reflected by the polygon mirror 31 and reaches the output optical system 35B. In the output optical system 35B, the laser beam travels via the fθ lens 47 and the reflecting mirrors 51 to 55 to exit the output optical system 35A through the dust preventing member 56 to irradiate the photosensitive drum 21Y.

As has been described above with reference to FIGS. 3 and 4, the LSU according to the present embodiment has the cooling passage 49U asymmetrically located relative to the rotation shaft AX of the motor 33. That is, the cooling passage 49U is disposed near the input optical system 39B where the temperature tends to be higher. This arrangement can reduce difference in the temperature distributions in the housing 37 caused by rotation of the motor 33 and thus effective to reduce the differences in deviations of the respective colors of an image formed on a sheet. In addition, the cooling passages 49U and 49L reduce the rise in the internal temperature of the housing 37, which can reduce the amount of deviation of images of the respective colors to be formed on a sheet.

Figure 5:
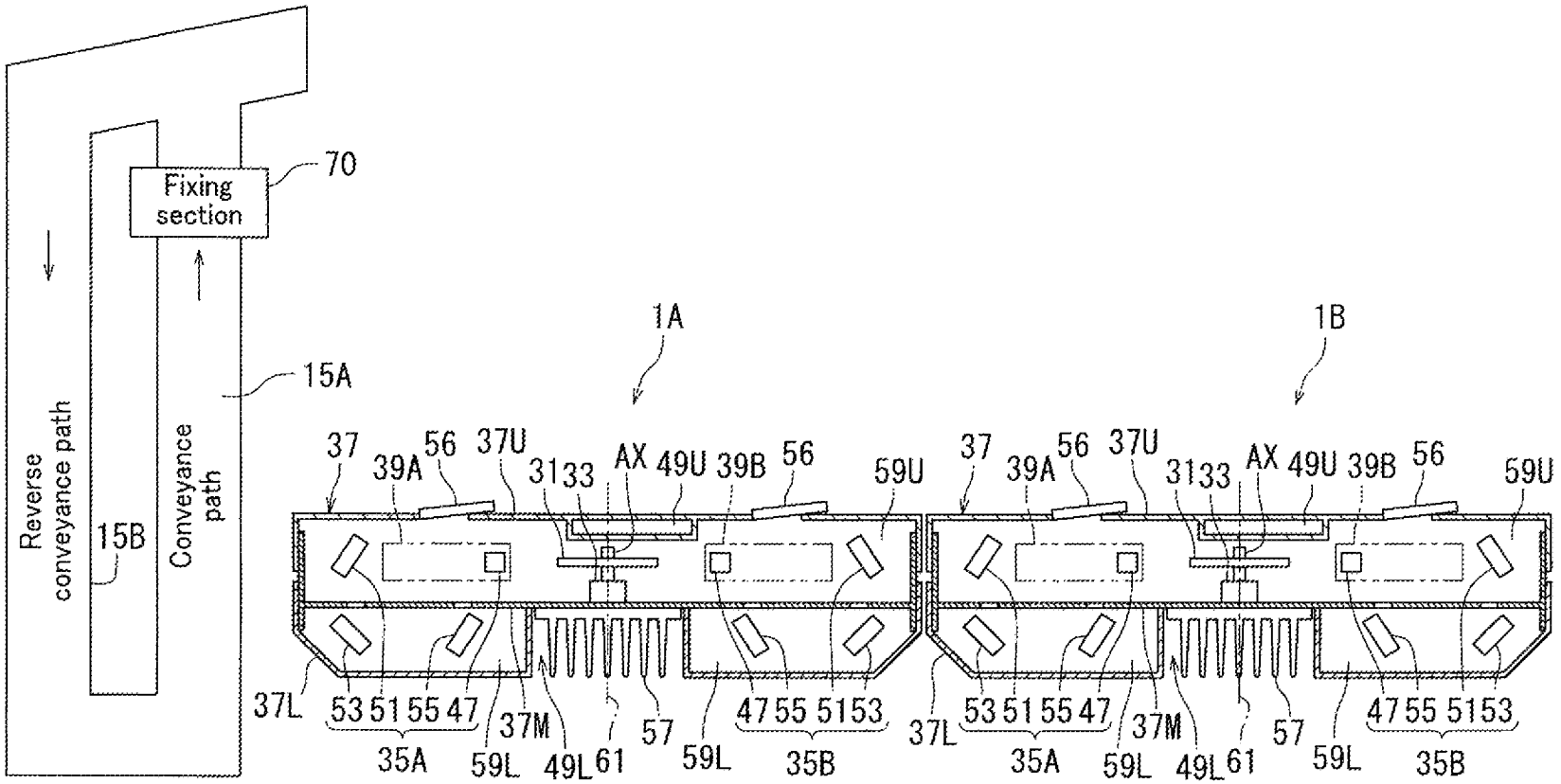
FIG. 5 shows the disposition of laser scanning units each according to the embodiment of the present disclosure.

In addition, according to the present embodiment, the input optical system 39B is located further away from the conveyance path 15A than the input optical system 39A is from the conveyance path 15A, as shown in FIG. 5. FIG. 5 shows the positions of the LSUs 1A and 1B. To form an image on the both sides of a sheet, the sheet is forwarded back to the conveyance path 15A through the reverse conveyance path 15B after heated by the fixing section 70. That is, the sheet subjected to hearing to fix the image thereon is conveyed though the conveyance path 15A. Naturally, the temperature of such a sheet conveyed through the conveyance path 15A is relatively high.

The LSU 1A is located laterally to the conveyance path 15A, and the LSU 1B is located next to the LSU 1A. In other words, the LSU 1A is disposed at a side of the conveyance path 15A and between the conveyance path 15A and the LSU 1B. The temperature of each of the LSUs 1A and 1B tends to be higher in a region where the input optical system 39B is located than in a region where the input optical system 39A is located, due to the rotation of the motor 33 in the rotation direction R1.

In view of this, the LSUs 1A and 1B each have the input optical system 39B that is located further away from the conveyance path 15A through which a sheet at a relatively high temperature may be conveyed, than the input optical system 39A is from the conveyance path 15A. This arrangement can reduce difference in the temperature distribution between the respective regions where the input optical systems 39A and 39B are located. In addition, disposing the cooling passage 49U at a location closer to the input optical system 39B than to the input optical system 39A is effective to further reduce difference in the temperature distribution between the respective regions where the input optical systems 39A and 39B are located.

Up to this point, the embodiment of the present disclosure has been described with reference to the accompanying drawings (FIGS. 1 to 5). Note however that the present disclosure is not limited to the specific embodiment described above and may be practiced through various other alterations (for example, those shown in (1) to (3) below) without departing from the gist of the present disclosure. The drawings schematically show the respective components in order to facilitate the understanding of the present disclosure. The thickness, length, number, and other properties of each element shown in the figures may be different from the actual ones for the convenience in the figures. In addition, the shape, dimensions, and other configurations of each component described in the above embodiment are merely examples and not limitations. Various alterations may be made without departing from the gist of the present disclosure.

(1) In the present embodiment, the motor 33 rotates in the rotation direction R1 as shown in FIG. 2. However, the motor 33 may rotate in the rotation direction R2, which is opposite to the rotation direction R1. When the motor 33 is set to rotate in the rotation direction R2, the temperature is expected to be higher in the region where the input optical system 39A is located than in the region where the input optical system 39B is located. The cooling passage 49U is therefore located closer to the input optical system 39A than to the input optical system 39B. In short, the cooling passage 49U is disposed at a location determined according to the rotation direction of the motor 33. In the case where the temperature distribution varies depending on the rotation direction of the motor 33, the cooling passage 49U is disposed at an effective location for reducing difference in the temperature distribution between the respective regions where the input optical systems 39A and 39B are located.

(2) The rotation direction of the motor 33 may be set after the location of the cooling passage 49U is determined. Also, the location of the cooling passage 49U may be determined after the rotation direction of the motor 33 is set.

(3) According to the present embodiment, the image forming apparatus 100 is a printer. However, the image forming apparatus 100 may be a copier, a facsimile machine, or a multifunction peripheral. A multifunction peripheral combines at least two of a copier, a printer, and a facsimile machine.

The present disclosure is applicable to the fields of image forming apparatuses having an optical scanning device and an optical scanning device mounted thereon.

What is claimed is:

1. An optical scanning device for forming an image on a scanning target by scanning the scanning target with light in a main scanning direction, the optical scanning device comprising:

a housing;

a polygon mirror disposed in the housing and configured to reflect light incident thereon while being rotated;

a motor disposed in the housing and configured to rotate the polygon mirror, a first optical system configure to emit light onto the polygon mirror; and a second optical system configured to emit light onto the polygon mirror, wherein the housing has a first cooling passage configured to cool an interior of the housing, the first cooling passage is asymmetrically located relative to a rotation shaft of the motor in a cross section perpendicular to the main scanning direction, the first optical system and the second optical system are located symmetrically to each other relative to the rotation shaft of the motor, the polygon mirror has a plurality of reflecting surfaces, and the motor rotates the polygon mirror such that one of the reflecting surfaces facing the first optical system is moved, over a shortest distance, to a position facing the second optical system, and the first cooling passage is located closer to the second optical system than to the first optical system.

2. The optical scanning device according to claim 1, wherein the first cooling passage is located at a position determined in accordance with a rotation direction of the motor.

3. The optical scanning device according to claim 1, wherein the second optical system is located farther away from a conveyance path of a sheet than the first optical system is, and the conveyance path is a path through which the sheet is conveyed after an image is fixed onto the sheet through heating.

4. An image forming apparatus, comprising:

the optical scanning device according to claim 1; and an image forming section configured to form an image on a sheet based on the image formed on the scanning target by the optical scanning device.

5. An image forming apparatus comprising:

two optical scanning devices each according to claim 1; and an image forming section for forming an image on a sheet based on images formed on the respective scanning targets by the optical scanning devices, wherein the image forming apparatus has a conveyance path through which the sheet is conveyed after the image is fixed thereto through heating, one of the two optical scanning devices is located at a side of the conveyance path and between the conveyance path and the other of the two optical scanning devices, and in each of the two optical scanning devices, the second optical system is located farther away from the conveyance path than the first optical system is.

6. An optical scanning device for forming an image on a scanning target by scanning the scanning target with light in a main scanning direction, the optical scanning device comprising:

a housing;

a polygon mirror disposed in the housing and configured to reflect light incident thereon while being rotated; and a motor disposed in the housing and configured to rotate the polygon mirror, wherein the housing has a first cooling passage configured to cool an interior of the housing, the first cooling passage is asymmetrically located relative to a rotation shaft of the motor in a cross section perpendicular to the main scanning direction, the interior of the housing is partitioned at least into a first space and a second space, the motor is located in the first space, the housing includes a cover that closes the first space, and the first cooling passage is formed in the cover and extends in the main scanning direction.

7. The optical scanning device according to claim 6, further comprising a blower, wherein the housing has a second cooling passage for cooling the interior of the housing, the second cooling passage is located symmetrically relative to the rotation shaft of the motor in a cross section perpendicular to the main scanning direction, the first cooling passage and the second cooling passage are located with the motor in between, and the blower is shared between the first cooling passage and the second cooling passage and configured to blow gas into the first cooling passage and the second cooling passage.

8. An image forming apparatus comprising:

the optical scanning device according to claim 6; and an image forming section configured to form an image on a sheet based on the image formed on the scanning target by the scanning device.

* * * * *